US005452926A

United States Patent [19]

Takimoto

[11] Patent Number: 5,452,926

[45] Date of Patent: Sep. 26, 1995

[54] LATCH ASSEMBLY

[75] Inventor: Kazuhide Takimoto, Tokyo, Japan

[73] Assignee: Takigen Manufacturing Co. Ltd., Tokyo, Japan

[21] Appl. No.: 191,810

[22] Filed: Feb. 3, 1994

[30] Foreign Application Priority Data

Feb. 18, 1993 [JP] Japan ..... 5-053085

[51] Int. Cl.[6] ..... E05C 19/14

[52] U.S. Cl. ..... 292/113; 292/341.12; 292/DIG. 49; 292/247

[58] Field of Search ..... 292/247, 113, 292/66, DIG. 49, 248, DIG. 11, DIG. 61, 341.12, 341.13

[56] References Cited

U.S. PATENT DOCUMENTS

| | | | |
|---|---|---|---|
| 1,024,054 | 4/1912 | Barnes | 292/66 |
| 2,704,218 | 2/1952 | Claud-Mantle | 292/DIG. 49 |
| 3,008,320 | 11/1961 | Cheney | 292/113 |
| 3,030,137 | 4/1962 | Cheney | 292/113 |
| 3,698,753 | 10/1972 | Alkinson | 292/247 |
| 3,885,407 | 5/1975 | Feinberg | 292/247 |
| 3,998,077 | 12/1976 | Bako | 292/113 |
| 4,008,584 | 2/1977 | Wingert | 292/247 |
| 4,074,549 | 2/1978 | Yee | 292/247 |
| 4,343,501 | 8/1982 | Meeks | 292/247 |

FOREIGN PATENT DOCUMENTS

| | | | |
|---|---|---|---|
| 1207081 | 2/1960 | France | 292/247 |
| 1476111 | of 1967 | France | 292/66 |
| 300427 | 10/1954 | Sweden | 292/247 |

*Primary Examiner*—Peter M. Cuomo
*Assistant Examiner*—Gary Estremsky
*Attorney, Agent, or Firm*—Martin Smolowitz

[57] ABSTRACT

Latch assembly which is free from unlocking accidents, enjoys smooth operations in locking of a wing element and in engaging of a latch arm with a socket member, and properly covers a gap between the wing element and a stationary frame. The gap is resulted from misalignment in assembling of the wing element and the stationary frame. In the assembly: a lever 3 has its base end pivoted to a base plate 1 through a pivot 4; a latch arm 5 has its base end pivoted to the lever 3 through a pivot 6; a locking plate 10 of the plate 1 has a locking socket 14 which is engaged with and disengaged from a front end of a stop member 13 fixed to a rotor 12 of a lock unit 11; a spring 15 has its coiled portion 16 mounted on the pivot 4 to bias the lever 3 upward; a support 30 carries the member 8 movable along a longitudinal direction of the arm 5; and, a spring 36 biases the member 8 away from the pivot 4.

3 Claims, 3 Drawing Sheets

LATCH ASSEMBLY

BACKGROUND OF THE INVENTION

1. Field of the Invention

The present invention relates to a latch assembly applied to an instrument box and the like.

2. Description of the Prior Art

In a conventional latch assembly disclosed in Japanese Utility Model Laid-Open No. Sho 61-17635, an operating lever has its base-end portion pivoted to a bearing plate portion of a base plate through a first pivot. The bearing plate portion projects from an end portion of the base plate. A latch arm has its base-end portion pivoted to an intermediate portion of the operating lever through a second pivot. The second pivot and the first pivot are so arranged that the base plate is closer to the second pivot than to a straight line drawn between the first pivot and an engaging-end portion of a socket member in a locking condition in which a front-end hook portion of the latch arm engages with the engaging-end portion of the socket member.

In the conventional assembly, since there is no means for locking the operating lever to the base plate, there is a fear that the latch arm is accidentally disengaged from the socket member to accidentally unlock the wing element on a stationary frame element when a front-end portion of the operating lever hits against some other articles to have the operating lever swung up on the first pivot.

Further, in the conventional assembly, since there is no means for holding the operating lever in its projected or swung-up position, the operating lever stays in its lying-down position on the base plate. Under such circumstances, when the wing element is closed, the front-end hook portion of the latch arm hits against a front-surface portion of the socket member, and, therefore is not engaged with the engaging-end portion of the socket member. Consequently, after the wing element is closed, it is necessary for a user to: pull up the base-end portion of the latch arm by temporarily swinging the operating lever upward; move the front-end hook portion of the latch arm toward the engaging-end portion of the socket member; and, then swingably push down the operating lever, which makes it difficult to smoothly close the wing element and also makes it difficult to have the latch arm engaged with the socket member.

In addition, in the conventional assembly, since the socket member is fixedly mounted on the wing element, when the wing element, is misaligned with the stationary frame, it is not possible to cover a gap which is resulted from such misalignment to appear between the wing element and the stationary frame. This makes it difficult to have the latch arm engaged with the socket member. Even if the latch arm is engaged with the socket member, it is not possible to closely fasten the wing element to the stationary frame.

SUMMARY OF THE INVENTION

It is an object of the present invention to provide a latch assembly which: is free from unlocking accidents even when an operating lever hits some other articles; makes it possible to smoothly close a wing element and to have a latch arm smoothly engaged with a socket member even when the wing element is misaligned with a stationary frame; and, to properly cover a clearance resulted from such misalignment.

The above object of the present invention is accomplished by providing:

a latch assembly comprising:

an operating lever having its base-end portion pivoted to bearing plate portions of a base plate through a first pivot, the bearing plate portions projecting from an end portion of the base plate;

a latch arm having its base-end portion pivoted to an intermediate portion of the operating lever through a second pivot;

the second pivot and the first pivot being so arranged that the base plate is closer to the second pivot than to a straight line drawn between the first pivot and an engaging-end portion of a socket member in a locking condition in which a front-end hook portion of the latch arm engages with the engaging-end portion of the socket member;

the base plate being provided with a locking plate portion in its other end portion, the locking plate portion being inserted in a rear-surface side cavity portion of the operating lever;

a lock unit fixedly embedded in the operating lever, the lock unit having its rotor connected with a stop-member plate;

the locking plate portion of the base plate being provided with a locking socket which is engaged with and disengaged from a front-end portion of the stop-member plate;

a coil spring having its coiled portion mounted on the first pivot in an insertion manner, its one linear end portion abutted against a spring-support portion of a base-end portion's rear surface of the operating lever, and its other linear end portion abutted against the bearing plate portion of the base plate to swingably bias the operating lever upward;

a support element to which the socket member is mounted to be movable along a longitudinal direction of the latch arm; and a spring for biasing the socket member so that the socket member is slidably moved away from the first pivot.

DESCRIPTION OF THE PREFERRED EMBODIMENTS

Figure 1:
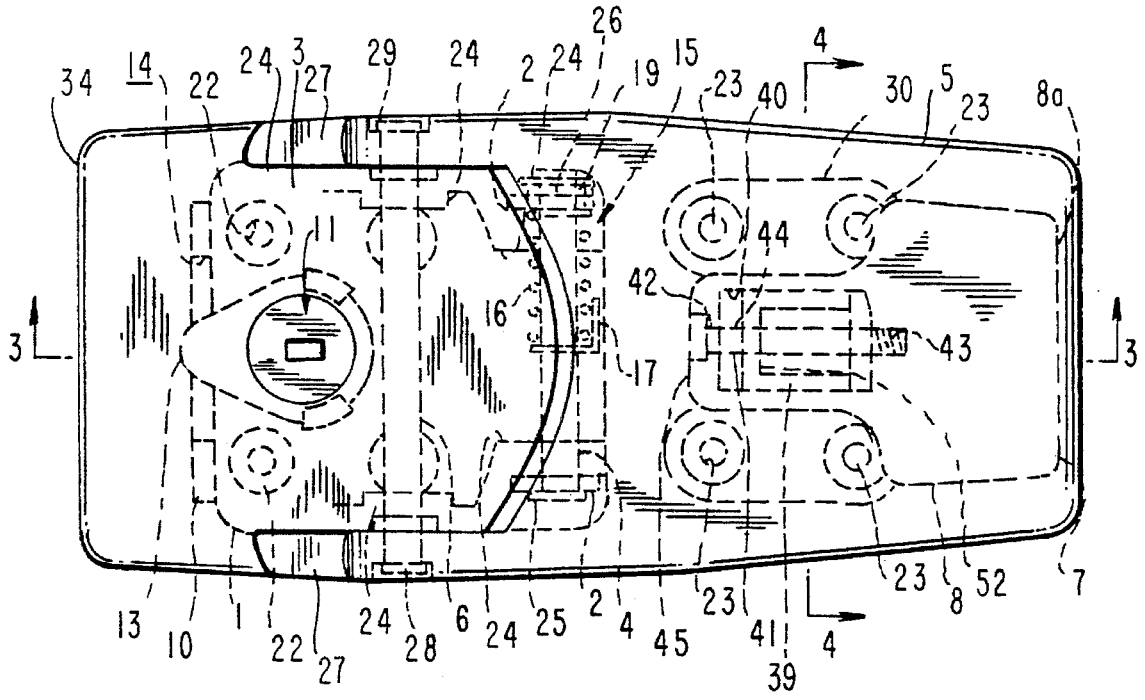
FIG. 1 is a front view of an embodiment of the latch assembly of the present invention in its locked condition.
Figure 2:
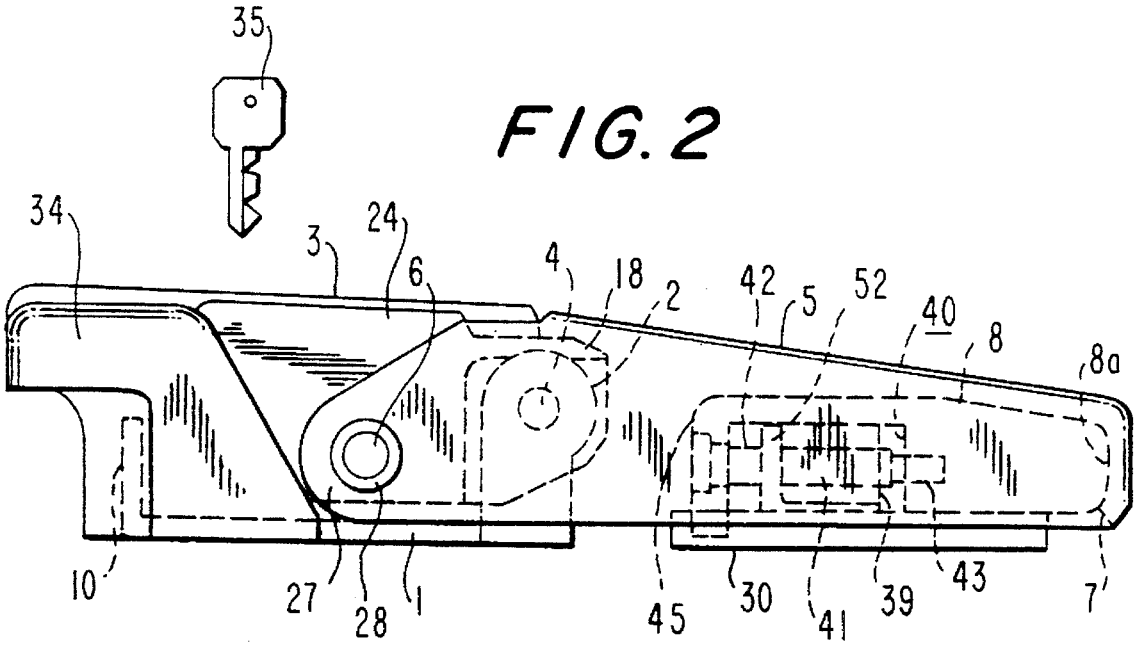
FIG. 2 is a side view of the latch assembly of the present; invention shown in FIG. 1.

Hereinbelow, the present invention will be described in detail with reference to the accompanying drawings and the reference numerals and characters.

In a latch assembly of the present invention, an operating lever 3 has its base-end portion pivoted to bearing plate portions 2, 2 of a base plate 1 through a first pivot 4. The bearing plate portions 2, 2 project from an end portion of the base plate 1. A latch arm 5 has its base-end portion pivoted to an intermediate portion of the operating lever 3 through a second pivot 6. The second pivot 6 and the first pivot 4 are so arranged that the base plate 1 is closer to the second pivot 6 than to a straight line drawn between the first pivot 4 and an engaging-end portion 8a of a socket member 8 in a locking condition in which a front-end hook portion 7 of the latch arm 5 engages with the engaging-end portion 8a of the socket member 8.

The base plate 1 is provided with a locking plate portion 10 in its other end portion. The locking plate portion 10 is inserted in a rear-surface side cavity portion 9 of the operating lever 3. A lock unit 11 is fixedly embedded in the operating lever 3, and has its rotor 12 connected with a stop-member plate 13. The locking plate portion 10 of the base plate 1 is provided with a locking socket 14 which is engaged with and disengaged from a front-end portion of the stop-member plate 13. A coil spring 15 has: its coiled portion 16 mounted on the first pivot 4 in an insertion manner, its one linear end portion 17 abutted against a spring-support portion 18 of a base-end portion's rear surface of the operating lever 3, and its the other linear end portion 19 abutted against the bearing plate per:lion 2 of the base plate 1, so as to swingably bias the operating lever 3 upward. A support element 30 carries the socket member 8 which is movable along a longitudinal direction of the latch arm 5. A spring 36 biases the socket member 8 so that the socket member 8 is slidably moved away from the first pivot 4.

Figure 3:
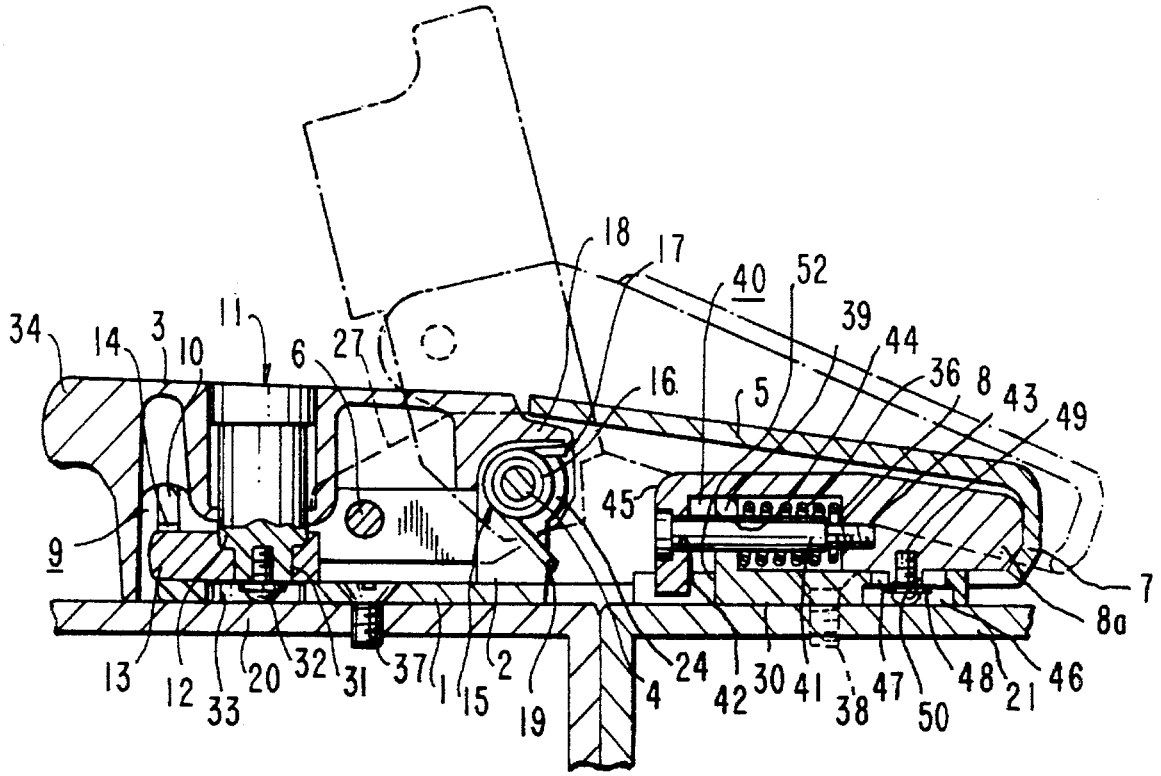
FIG. 3 is a longitudinal sectional view of the latch assembly of the present invention, taken along the line A—A of FIG. 1.

In a condition in which a wing element 20 is closed and locked to a stationary frame 21: the operating lever 3 lies on the base plate 1; as shown in FIG. 3, the base plate 1 is closer to the second pivot 6 then to the straight line drawn between the first pivot 4 and the engaging-end portion 8a of the socket member 8; the locking plate portion 10 of the base plate 1 is inserted in the rear surface side cavity portion 9; and, the stop-member plate 13 of the lock unit 11 is engaged with the locking socket 14 of the locking plate portion 10.

In order to unlock the latch assembly to release the wing element 20, it, is necessary to insert a predetermined key 35 into the lock unit 11 and rotate the rotor 12 so that the stop-member plate 13 is disengaged from the locking socket 14. After that, the user puts his fingers to a front-end portion of the operating lever 3 to swing up the same lever 3 on the first pivot 4, which moves the second pivot 6 away from the base plate 1 so that the latch arm 5 having been swung upward on the second pivot 6 has its front-end hook portion 7 disengaged from the engaging-end portion 8a of the socket member 8.

Then, when the operating lever 3 is released from the user's fingers, the lever 3 is held in its projected or swung-up position away from the base plate 1 under the influence of a resilient force exerted by the coil spring 15, so that the front-end hook portion 7 of the latch arm 5 is horizontally moved away from the socket, member 8 while keeping in contact with a front-surface plate portion of the stationary frame 21. Consequently, there is no fear that the front-end hook portion 7 of the latch arm 5 engages with the engaging-end portion 8a of the socket member 8 when the wing element 20 is opened. Further, there is no fear that the front-end hook portion 7 of the latch arm 5 hits against the engaging-end portion 8a of the socket; member 8 when the wing element 20 is closed.

After the wing element 20 is closed, when the operating lever 3 is swung down on the first pivot 4, the front-end hook portion 7 of the latch arm 5 moves toward the engaging-end portion 8a of the socket member 8 while keeping in contact with the front-surface plate portion of the stationary frame 21. As a result, when the base plate 1 becomes closer to the second pivot 6 than to the straight line drawn between the first pivot 4 and the engaging-end portion 8a of the socket member 8, the front-end hook portion 7 of the latch arm 5 is firmly engaged with the engaging-end portion 8a of the socket member 8, so that the wing element 20 is locked to the stationary frame 21. At this time, the socket member 8 moves along a longitudinal direction of the latch arm 5 so as to have the wing element 20 brought into a close contact with the stationary frame 21. Under the influence of the resilient force exerted by the spring 36, the front-end hook portion 7 of the latch arm 5 is further firmly engaged with the engaging-end portion 8a of the socket member 8.

In the embodiment of the present invention shown in the drawings, the base plate 1 is fixedly mounted on the wing element 20 by means of fasteners 37 such as screws passed through four mounting holes 22 of the base plate 1. On the other hand, the support element 30 for the socket member 8 is fixedly mounted on the stationary frame 21 by means of fasteners 38 such as screws passed through four mounting holes 23 of the support element 30. The number of the bearing plate portions 2 of the base plate 1 is two and which are vertically arranged so as to project forward from the base plate 1. The first pivot 4 is a cross pivot interposed between right-end portions of a vertically-arranged pair of side-wall plate portions 24, 24 of the operating lever 3. The first pivot 4 has its large-diameter base-end portion 25 abutted against a lower one of the bearing plate portions 2. On the other hand, a stop ring 26 fixedly mounted on a front-end portion of the first pivot 4 abuts against the other one or upper one of the bearing plate portions 2.

The second pivot 6 is a cross pivot interposed between intermediate portions of a vertically-arranged pair of side-wall plate portions 24, 24 of the operating lever 3, and between left-hand portions of a vertically-arranged pair of side-wall plate portions 27, 27 of the latch arm 5. The second pivot 6 has its large-diameter base-end portion 28 abutted against a lower one of the side-wall plate portions 27 of the latch arm 5. A front-end portion 29 of the second pivot 6 is press-staked to abut against the upper one of the side-wall plate portions 27. A front-end portion of the linear end portion 19 of the coil spring 15 is bent to prevent the first cross pivot 4 from axially moving, and abuts against the above stop ring 26.

The stop-member plate 13 is provided with a through-hole 31 in its base-end portion, through which through-hole 31 the stop-member plate 13 is mounted on a rear-end square-column portion of the rotor 12 in an insertion manner so as to be non-rotatable relative to the rotor 12, and is fastened to the rotor by a screw 32. The base plate 1 is provided with a through-hole 33 for receiving the screw 32 therein. The operating lever 3 is provided with a finger-engaging projection 34 in its left-end portion. The lock unit 11 may be any one of conventional lock units incorporating therein known locking mechanisms such as pin tumbler type locking mechanisms, disk-tumbler locking mechanisms, axial-pin tumbler mechanisms and the like.

Figure 4:
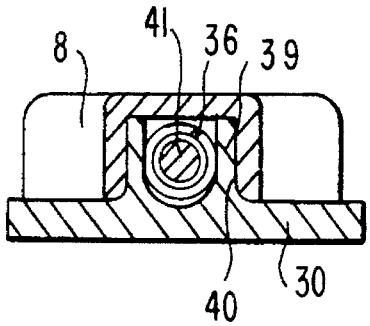
FIG. 4 is a cross-sectional view of the latch assembly of the present invention, taken along the line B—B of FIG. 1.

As shown in FIG. 4, the support element 30 is provided with a guide portion 39 in its front surface's central portion. The guide portion 39 substantially assumes a U-shaped form as viewed in its plane view, projects from the front surface's central portion of the support element 30, and embedded in a cavity portion 40 of a rear surface of a left-end half of the socket member 8. A guide shaft 41 is inserted in a through-hole 42 of a left-side wall 45 of the cavity portion 40, passes through a through-hole 44 of a central connecting wall portion 52 of the guide portion 39, and is threadably connected with a threaded hole 43 of the socket member 8, which is movable in a longitudinal direction of the latch arm 5 by an amount corresponding to a difference in length between the guide portion 39 and the cavity portion 40.

The support element 30 is provided with an elongated guide hole 47 extending in a longitudinal direction of a left-end portion of the support element 30. Inserted in the elongated guide hole 47 of the support element 30 is a rear-surface projection 50 of the socket member 8. A washer 48 is fixed to the rear-surface projection 50 by a screw 49 threadably engaged with the projection 50, and abuts against a hole edge portion of a rear-surface side of the elongated guide hole 47 of the support element 30. The compression spring 36 is mounted on the guide shaft 41 in an insertion manner, and compressed between: the central connecting wall portion 52 of the guide portion 39; and a right-side inner wall surface of the cavity portion 40, so as to slidably bias the socket member 8. The support element 30 is provided in its rear-surface side with a concave portion 46 for receiving the screw 49 therein.

In the latch assembly of the present invention having the above construction: the operating lever 3 has its base-end portion pivoted to the bearing plate portions 2, 2 of an end portion of the base plate 1 through the first pivot 4; the latch arm 5 has its base-end portion pivoted to the intermediate portion of the operating lever 3 through the second pivot 6; the locking plate portion 10 of the base plate 1 is provided with the locking socket 14; and, the lock unit 11 is fixedly embedded in the operating lever 3, the lock unit 11 having its color 12 connected with the stop-member plate 13. Consequently, when the wing element 20 is locked to the stationary frame 21, it is possible to lock the operating lever 3 to the base plate 1 by having the front-end portion of the stop-member plate 13 engaged with the locking socket 14. Therefore, in the latch assembly of the present invention, there is no fear that the operating lever 3 is swingably pulled up so as to be accidentally unlocked even when it is hit by some other article.

In the latch assembly of the present invention, since the locking plate portion 10 of the base plate 1 is so formed into a shape insertable into the rear-surface side cavity portion 9 of the operating lever 3, it is possible to reduce the entire height of the assembly in a condition in which the assembly is locked.

Further, in the latch assembly of the present invention, the coil spring 15, which has its coiled portion 16 mounted on the first pivot 4 in an insertion manner, has its one linear end portion 17 abutted against the spring-support portion 18 of the base-end portion's rear surface of the operating lever 3 and the other linear end portion 19 abutted against the bearing plate portion 2 of the base plate 1, so that the operating lever 3 is swingably biased upward. Consequently, it is possible to smoothly close the wing element 20 and to have the latch arm 5 smoothly engaged with the socket member 8, which improve the assembly in its handling properties.

Furthermore, in the latch assembly of the present invention: the socket member 8 is mounted on the support element 30 so as to be movable in a longitudinal direction of the latch arm 5; and, the socket member 8 is so biased as to be slidably moved away from the first pivot 4. Consequently, the socket member 8 is firmly engaged with the latch arm 5 without fail. Even when the wing element 20 is misaligned with the stationary frame 21, there is no fear that the socket member 8 can not be engaged with the latch arm 5. In addition, a clearance or gap caused from such misalignment may be properly covered by the latch assembly of the present invention.

What is claimed is:

1. A latch assembly, comprising:

an operating lever (3) having its base-end portion pivoted to bearing plate portions (2, 2) of a base plate (1) through a first pivot (4), the bearing plate portions (2, 2) projecting from an end portion of said base plate (1);

a latch arm (5) having its base-end portion pivoted to an intermediate portion of said operating lever (3) through a second pivot (6);

said second pivot (6) and said first pivot (4) being so arranged that said base plate (1) is closer to said second pivot (6) than to a straight line drawn between said first pivot (4) and an engaging-end portion (**8*a*) of a socket member (8) in a locking condition, in which a front-end hook portion (7) of said latch arm (5) engages with said engaging-end portion (8*a*) of said socket member (8**);

said base plate (1) being provided with a locking plate portion (10) in its other end portion, said locking plate portion (10) being inserted in a rear-surface side cavity portion (9) of said operating lever (3);

a lock unit (11) fixedly embedded in said operating lever (3), said lock unit (11) having its rotor (12) connected with a stop-member plate (13);

said locking plate portion (10) of said base plate (1) being provided with a locking socket (14) which is engaged with and disengaged from a front-end portion of said stop-member plate (13);

a coil spring (15) having its coiled portion (16) mounted on said first pivot (4) in an insertion manner, its one linear end portion (17) abutted against a spring-support portion (18) of a base-end portion's rear surface of said operating lever (3), and its other linear end portion (19) abutted against said bearing plate portion (2) of said base plate (1) to swingably bias said operating lever (3) upward;

a support element (30) to which said socket member (8) is mounted to be movable along a longitudinal direction of said latch arm (5), and enclosed within said latch arm (5); and a spring (36) provided within said socket member (8) for biasing said socket member (8) so that said socket member (8) is slidably moved away from said first pivot (4).

2. The latch assembly of claim 1, wherein said support element (30) is fixedly-mounted onto a stationary frame (21).

3. The latch assembly of claim 1, wherein said socket member (8) is resiliently mounted onto said support element (30) by compression spring (36) provided around a guide shaft (41).

* * * * *